US006369766B1

(12) United States Patent
Strickland et al.

(10) Patent No.: US 6,369,766 B1
(45) Date of Patent: Apr. 9, 2002

(54) OMNIDIRECTIONAL ANTENNA UTILIZING AN ASYMMETRICAL BICONE AS A PASSIVE FEED FOR A RADIATING ELEMENT

(75) Inventors: Peter C. Strickland, Ottawa (CA); Kurt Alan Zimmerman, Atlanta, GA (US); John Elliott Wann, Dacula, GA (US); Thomas Steven Taylor, Atlanta, GA (US)

(73) Assignee: EMS Technologies, Inc., Norcross, GA (US)

( * ) Notice: Subject to any disclaimer, the term of this patent is extended or adjusted under 35 U.S.C. 154(b) by 0 days.

(21) Appl. No.: 09/461,689

(22) Filed: Dec. 14, 1999

(51) Int. Cl.[7] ..... H01Q 1/32

(52) U.S. Cl. ..... 343/713; 343/773

(58) Field of Search ..... 343/773, 713, 343/772; H01Q 1/32

(56) References Cited

U.S. PATENT DOCUMENTS

| | | | | | |
|---|---|---|---|---|---|
| 2,532,551 | A | | 12/1950 | Jarvis | 250/33.63 |
| 2,726,388 | A | | 12/1955 | Kandolan et al. | 343/774 |
| 2,771,605 | A | | 11/1956 | Kirkman | 343/771 |
| 2,866,194 | A | | 12/1958 | Stavis et al. | 343/725 |
| 2,954,558 | A | | 9/1960 | Honey et al. | 343/773 |
| 3,618,107 | A | * | 11/1971 | Spanos | 343/773 |
| 3,747,111 | A | | 7/1973 | Fletcher et al. | 343/803 |
| 3,829,863 | A | | 8/1974 | Lipsky | 343/773 |
| 4,143,377 | A | * | 3/1979 | Salvat et al. | 343/755 |
| 4,170,777 | A | * | 10/1979 | Liautaud | 343/715 |
| 4,218,684 | A | * | 8/1980 | Northcutt | 343/715 |
| 4,225,869 | A | * | 9/1980 | Lohrmann | 343/773 |
| 4,543,584 | A | * | 9/1985 | Leer | 343/881 |
| 4,692,770 | A | * | 9/1987 | Kadokura | 343/715 |
| 4,857,939 | A | * | 8/1989 | Shimazaki | 343/715 |
| 4,947,181 | A | * | 8/1990 | Duncan et al. | 343/773 |
| 4,959,657 | A | | 9/1990 | Mochizuki | 343/725 |
| 5,038,152 | A | * | 8/1991 | Wong et al. | 343/756 |
| 5,134,420 | A | | 7/1992 | Rosen et al. | 343/756 |
| 5,140,334 | A | | 8/1992 | Snyder et al. | 343/773 |
| 5,157,410 | A | * | 10/1992 | Konishi | 343/715 |
| 5,389,942 | A | * | 2/1995 | Oglesby, Jr. | 343/872 |
| 5,561,439 | A | * | 10/1996 | Moilanen | 343/846 |
| 5,565,877 | A | * | 10/1996 | Du et al. | 343/715 |
| 5,600,340 | A | | 2/1997 | Ho et al. | 343/846 |
| 5,608,416 | A | | 3/1997 | Champion | 343/773 |
| 5,767,814 | A | | 6/1998 | Conroy et al. | 343/774 |
| 5,990,840 | A | * | 11/1999 | Chang | 343/713 |
| 6,198,454 | B1 | * | 3/2001 | Sharp et al. | 343/773 |

FOREIGN PATENT DOCUMENTS

| | | |
|---|---|---|
| DE | 31 22 016 | 12/1982 |
| FR | 2 573 576 | 5/1986 |

* cited by examiner

*Primary Examiner*—Don Wong
*Assistant Examiner*—Trinh Vo Dinh
(74) *Attorney, Agent, or Firm*—King & Spalding

(57) ABSTRACT

An antenna assembly comprising a radiating element which passively receives a signal fed by a vertically-stacked pair of asymmetrically-shaped, conductive cone elements mounted below the radiating element. The cone elements are centrally fed by a coaxial cable input at a common junction formed the apex of each cone element. This antenna assembly provides a low-profile antenna to transmit and receive radio frequency (RF) energy with high gain and desirable antenna patterns for data transmission in an in-building, wireless local area network. The antenna assembly can be mounted in a standard ceiling or wall-mounted enclosure, with the low-profile antenna extending beneath the surface of a conductive enclosure cover that serves as the ground plane for the antenna element. This configuration achieves high antenna gain with a downtilt-beam, omnidirectional radiation pattern, which is highly desirable in an in-building wireless local area network (WLAN) application.

27 Claims, 4 Drawing Sheets

OMNIDIRECTIONAL ANTENNA UTILIZING AN ASYMMETRICAL BICONE AS A PASSIVE FEED FOR A RADIATING ELEMENT

TECHNICAL FIELD OF THE INVENTION

The present invention is directed to an omnidirectional antenna having a radiating element that is passively fed with electromagnetic signals by an asymmetrical-shaped pair of cones or discs. The invention is particularly well suited for low-profile antenna applications involving the transmission and reception of data in wireless local area networks.

BACKGROUND OF THE INVENTION

Low profile antennas are desirable for use in in-building wireless local area network (WLAN) applications. However, it has been technically difficult to balance the requirements for high gain and desirable antenna patterns for in-building communication applications when the antenna is limited to a physically small structure.

Antenna designers appreciate that antenna gain can be improved by placing the radiating element above a large, conductive surface, such as a ground plane. A large ground plane also can support the desired shaping of an antenna pattern. Common design requirements for a ground plane of a low-profile antenna are a conductive material comprising a relatively large surface, typically greater than 5 wavelengths. This conductive material can comprise either a solid surface or a grid having holes of a diameter less than 0.1 wavelength. Although an infinitely large ground plate provides a theoretically ideal conductive surface, conventional low-profile antenna designs often face "real estate" constraints. Consequently, low-profile antennas are often limited in their performance by a reduced ground plane size and the limited physical size of a radiating element within the practical constraints of an indoor, workplace environment. For example, a dipole antenna having a direct, active signal feed and constrained by a low-profile configuration can lack sufficient gain to support effective wireless communications in the high multipath environment of a typical indoor WLAN application.

In prior antenna designs, designers have achieved additional gain and desirable radiation patterns by the incorporation of stacked cone and/or disk elements as part of the antenna assembly. Conventional antenna designs have employed cone- or disk-shaped elements that operate in tandem to reflect electromagnetic energy in a manner similar to that of a horn antenna. Other prior antenna designs have used stacked biconical elements to form an array of radiating elements, typically fed by a central coaxial feed or a waveguide distribution network. For example, a discone antenna design has been implemented with stacked vertical, hollow conical elements to eliminate signal reflections and to improve antenna bandwidth. However, these prior antenna designs have not exhibited the physical characteristics required of a low-profile antenna application involving minimal available real estate.

In view of the foregoing, a need exists for a low-profile antenna system for WLAN applications that provides increased gain and more desirable radiation patterns than is possible with existing antenna designs.

SUMMARY OF THE INVENTION

The present invention provides significant advantages over the prior art by providing a low-profile antenna to transmit radio frequency (RF) energy with high gain and desirable output patterns, typically for data transmission in an in-building, wireless local area network (WLAN). In general, the present invention is directed to an antenna having an emitter element, such as a dipole, which passively receives a signal feed from a vertically stacked pair of asymmetrically-shaped cone elements. The cone elements or discs form a bicone assembly that is centrally fed by a coaxial cable input at a junction formed by an indirect coupling of the apex of each cone. This inventive antenna assembly can be mounted with a standard wall or ceiling-mounted enclosure, with the low-profile antenna typically extending beneath a metallic enclosure cover that serves as a ground plane.

The present invention generally provides a low-profile, omnidirectional antenna system, employing an asymmetrical bicone design with a passive feed for an emitter element, such as a dipole element. A feed signal can be delivered via a conventional coaxial cable, which centrally feeds a pair of stacked, conductive bicone elements mounted below the dipole element. The coaxial cable is used to distribute electromagnetic energy from a source to the bicone elements, with the center conductor connected to the upper cone and the outer conductive sheath or mesh connected to the lower cone. The bicone elements, which are stacked within the vertical plane of the antenna, are indirectly coupled at a common junction formed by an insulator mounted to the apex of each cone. One or more insulators also can be used to separate the combination of upper and lower stacked cones and a vertically-mounted dipole element. The dipole element is supported within the vertical plane of the antenna by the upper cone. This configuration results in a passive coupling of electromagnetic energy within the vertical plane of the antenna assembly and to the dipole element.

The bicone insulator, which is mounted between the upper and lower cones, can provide the sole mechanical support of the upper cone for one aspect of the present invention. For one aspect of the present invention, the bicone insulator can comprise a threaded insulator of non-conductive material having an internal UNF 4-40 thread and an UNC 10-24 external thread. The female contact receptacle of the bicone insulator accepts the bottom tip of the upper cone and the male contact member fits within an opening of the lower cone to form the common junction between the upper and lower cone elements. The bicone insulator controls the dielectric capacitance between the upper and lower cones. Because the center conductor of the coaxial feed cable passes through an opening in the bicone insulator and into the upper cone, this insulator provides the dielectric loading of a low impedance coaxial transmission line. It will be appreciated that this combination of components for the inventive antenna can be assembled without tools and in the absence of any soldering of the central conductor of the feed coaxial cable to the antenna itself. This supports a low cost implementation of a lower profile antenna for wireless communication applications, such as indoor applications.

For one aspect of the present invention, the antenna can be used in connection with a ceiling-mounted enclosure housing a communications device. In this operating environment, the emitter element of the antenna is typically mounted perpendicular to a conductive enclosure cover operating as a conductive ground plane. Because the enclosure and its cover are typically mounted along the ceiling of an interior location, the mounted antenna points downward toward the interior. The ground plane, which can be provided by a solid or grid-like surface of a metallic ceiling tile, is useful for increasing antenna gain and shaping the beam width within the elevation plane. In particular, the combination of a ceiling-mounted ground plane with the inventive passive feed network for an emitter or radiating element results in an antenna exhibiting a decreased beam width within the elevation plane while exhibiting desirable downtilt beam characteristics. The resulting downtilt radiation pattern is particularly desirable in a ceiling-mounted WLAN application.

That the invention provides an antenna having a bicone assembly for passively coupling electromagnetic energy to and from a dipole element will become apparent from the following detailed description of the exemplary embodiments and the appended drawings and claims.

DETAILED DESCRIPTION OF EXEMPLARY EMBODIMENTS

The antenna of the present invention is primarily useful for transmitting and/or receiving radio frequency (RF) signals in applications, such as wireless local area computer networks (WLAN), where efficient, unobtrusive operation is desired. Although the inventive antenna can operate as a monopole without a ground plane, the preferred operating environment comprises the combination of an exemplary embodiment of the antenna with a conductive ground plane. In its preferred application, the antenna assembly can be mounted on a conductive ground plane, such a ceiling tile or grid. For a typical wall or ceiling-mounted antenna application, the conductive surface of the ground plane is typically provided by a custom or existing enclosure cover, such as the type covering an HVAC vent or a speaker for an audio or paging system.

It will be appreciated that a ground plane is useful for increasing antenna gain or shaping the beam width within the elevation plane. In particular, the combination of the ground plane with the inventive antenna results in an antenna exhibiting a decreased beam width within the elevation plane while exhibiting desirable downtilt beam characteristics. When combined with a ground plane implemented by a conductive ceiling tile, the antenna is typically connected to a communications device mounted with the ceiling enclosure to support a WLAN. Consequently, the emitter element of the antenna typically points downward toward the interior of a room when the antenna is mounted perpendicular to a ceiling tile operating as a conductive ground plane.

Figure 1:
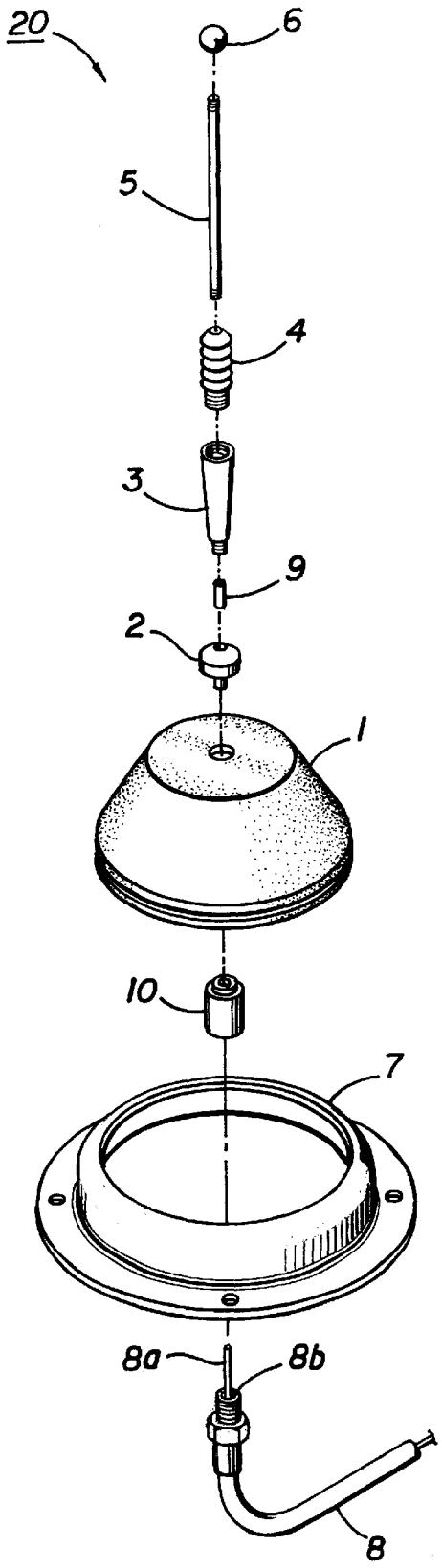
FIG. 1 is an illustration showing an exploded representation of an assembly of an antenna for an exemplary embodiment of the present invention.
Figure 2:
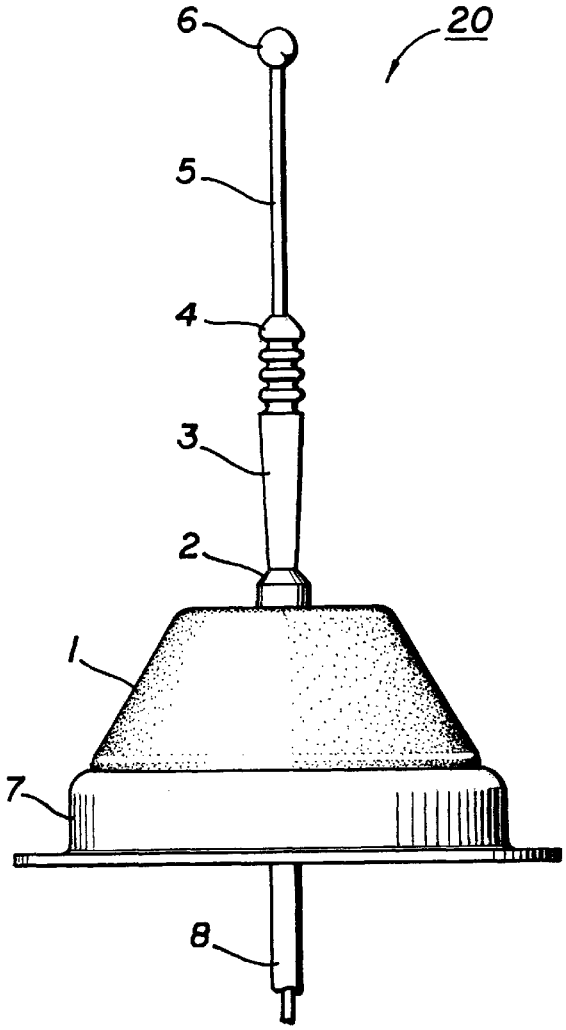
FIG. 2 is an illustration showing a side view of an assembled representation of the exemplary antenna shown in FIG. 1.
Figure 3:
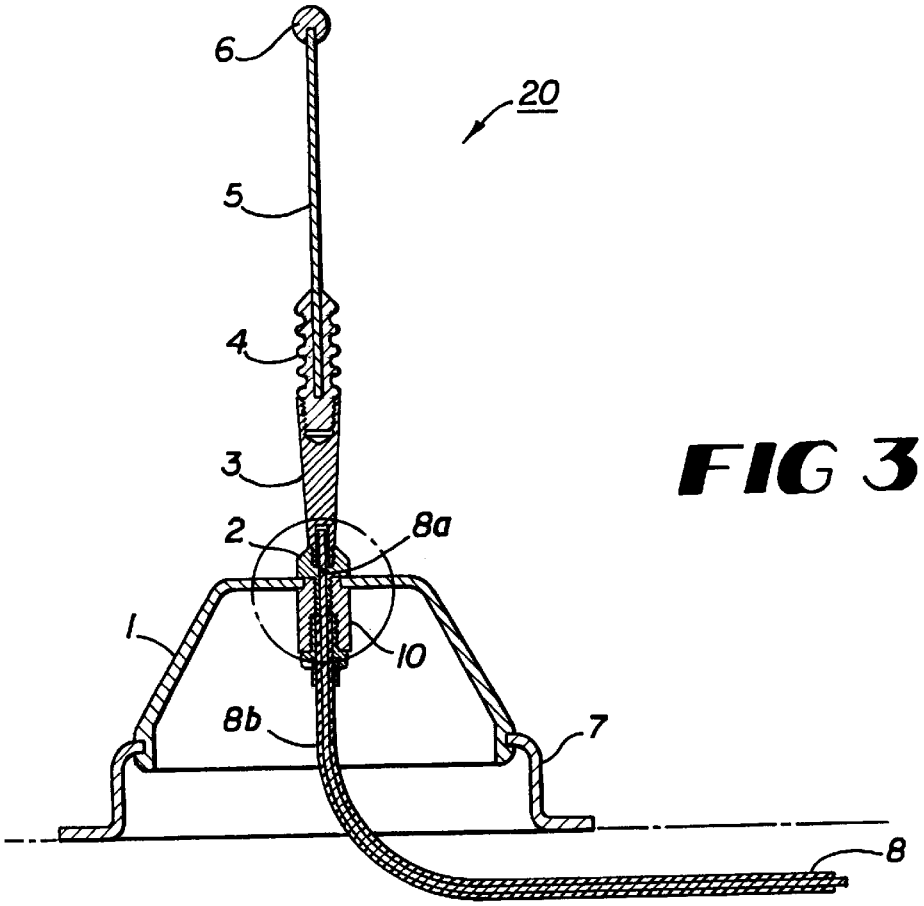
FIG. 3 is an illustration showing a cross-sectional view of an assembled representation of the exemplary antenna shown in FIG. 1.
Figure 4:
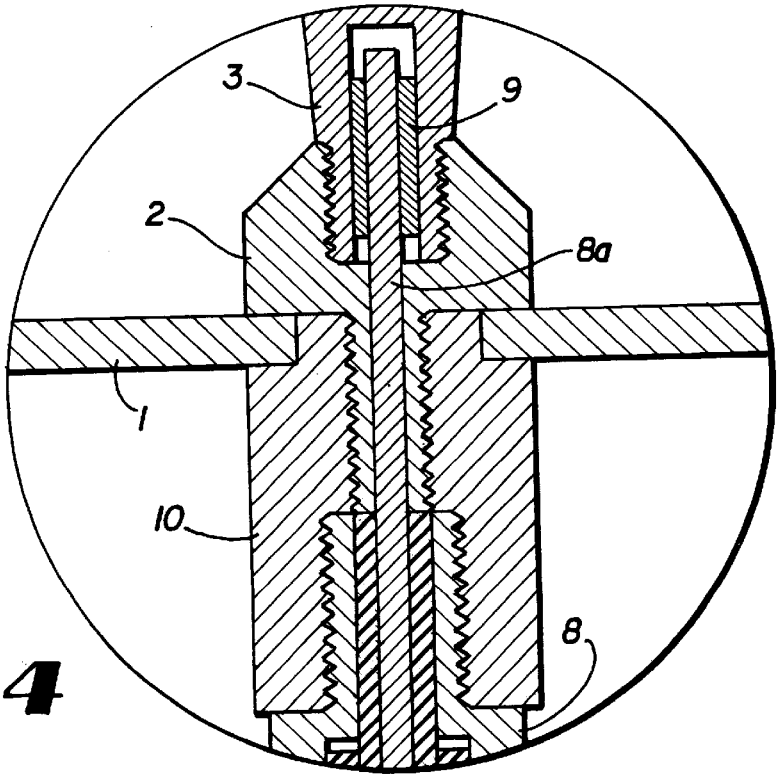
FIG. 4 is an illustration showing an enlarged detail of a cross sectional-view of the exemplary antenna shown in FIG. 1.

Exemplary embodiments of the invention will now be described with reference to the drawings, in which like numerals refer to like elements throughout the several figures. FIG. 1 is an exploded view illustration showing the primary components of an exemplary embodiment of the antenna. FIGS. 2 and 3 show side and cross-sectional views of an assembled version of the antenna illustrated in FIG. 1. FIG. 4 shows a detailed view of a coaxial interface to the exemplary antenna, including a coaxial cable input, a non-conductive adapter, a basal cone, an insulator, a receptacle pin, and an upper cone. Although transmission operations of the antenna are primarily explained below in connection with FIGS. 1–4, those skilled in the art will appreciate that the antenna is also capable of supporting receive operations based on the reciprocal flow of electromagnetic signals for the antenna design. Consequently, the reference to a radiating or emitter element for the inventive antenna operating in support of transmission applications is also applicable to receive applications involving reception of electromagnetic signals by this antenna element.

As shown in FIGS. 1–2, an exemplary antenna 20 comprises a basal cone 1, an upper cone 3, and a dipole element 5. The basal cone 1 and the upper cone 3 form a bicone element having a central junction formed by the apex of each cone and is fed electromagnetic energy by a transmission medium, such as a coaxial cable. An insulator 2 can be placed at this central junction to physically separate each of the cones 1 and 3, thereby electrically isolating the conductive surfaces of the cones. An insulator provided by an adapter 4 connects the upper cone 3 to a vertically-mounted radiating element provided by the dipole element 5. The basal cone 1 preferably has a wide cone shape, whereas the upper cone 3 preferably has a narrow cone shape. This preferred asymmetrical configuration for the pair of cones 1 and 3 supports the passive coupling of electromagnetic energy to and from the dipole element 5 within the vertical plane of the antenna 20. The asymmetrical shape for the cone pair affects the input impedance at the central feed point located at the cone junction, while further supporting a relatively broad operational frequency range for the antenna 20, and increasing coupling to the dipole element 5.

The basal cone 1 is preferably implemented as a truncated, wide-based cone comprising aluminum or a similarly conductive material. A representative implementation of the basal cone 1 is hollow, with an open base and a flattened upper face which contains a central aperture. The insulator 2, also described as a bicone insulator, can be mounted to the exterior portion of the basal cone 1, typically at the central aperture of the cone. The basal cone 1 can be supported by a base insulator 7, which is useful for mounting the antenna 20 to the desired substrate structure.

The upper cone 3 is preferably an inverted, narrow-angled cone of solid aluminum, or similarly conductive metal. At the narrower, basal end of the upper cone 3 is a central recess sized to accommodate a pin receptacle 9. At the broader, opposite end of the upper cone 3 is a central recess sized to accommodate the formed base of a nonconductive, cylindrical adapter 4. The cylindrical adapter 4 connects the upper cone 3 to the rod-like, dipole element 5 within the vertical plane of the antenna 20. The dipole element 5 terminates with a plastic end cap 6, which is typically employed for safety reasons.

An electromagnetic signal can be carried by a transmission medium and delivered to a central junction located between the basal cone 1 and the upper cone 3. The insulator 2, which preferably has a low dielectric permittivity, is mounted at this junction between both the lower cone 1 and the upper cone 3. For the preferred embodiment, the transmission medium is implemented by a coaxial cable 8 comprising a center conductor 8*a* and an outer sheath 8*b*. A cylindrical adapter 10, which includes an opening extending throughout its length, is positioned within the hollow portion of the basal cone 1 and receives the coaxial cable 8. The adapter 10 establishes an electrical connection between the outer conductive sheath 8*b* and the conductive interior surface of the basal cone 1. The coaxial cable conductor 8*a* extends through the length-wise opening of the cylindrical adapter 10 and protrudes through the central aperture in the upper surface of the basal cone 1. The central coaxial conductor 8*a* passes through a central opening in the insulator 2, which is positioned adjacent to the exterior portion of the aperture of the basal cone 1, and terminates at the conductive pin receptacle 9 positioned within a recess of the upper cone 3.

The basal cone 1 and the upper cone 3, which are separated by the insulator 2, operate in tandem to create an electromagnetic field within the vertical plane of the antenna assembly when a signal is actively fed to the bicone assembly. Specifically, electromagnetic energy is typically supplied to the upper cone 3 through the coaxial cable conductor 8*a*, which terminates in the pin receptacle 9 at the upper cone 3. The electromagnetic field created by the vertically-stacked array of the basal cone 1 and the upper cone 3 passively feeds the dipole element 5, which is vertically mounted above the cone array with the interposition of the insulating adapter 4. The central nature of the feed by the coaxial cable into a pair of cones, each having a symmetrical shape about their respective central axes, results in the coupling of electromagnetic energy to the dipole element 5 and the generation of an omnidirectional radiation pattern. This passive coupling of electromagnetic energy to (and from) the dipole element 5 ultimately yields a transmitted (received) signal by the dipole with significantly increased gain characteristics.

As shown in FIGS. 3 and 4, the coupling of the coaxial outer conductor or sheath to the interior portion of the basal cone 1 is accomplished by an interconnection with the adapter 10. In contrast, the central coaxial conductor 8*a* actively feeds the upper cone 3 by extending through openings in both the basal cone 1 and the insulator 2 to terminate in the pin receptacle 9, which is mounted within a recess of the apex of the upper cone 3. The insulator 2 isolates the conductive surface of the coaxial cable conductor 8*a* from the conductive surface of the basal cone 1. Similarly, the insulator 2 also physically separates the apex of the basal cone 1 from the apex of the upper cone 3, thereby isolating the conductive surfaces of this cone pair. A signal that is transmitted through the coaxial cable conductor 8*a* to the antenna 20 provides a direct feed, exciting the upper cone 3 and creating a desirable electromagnetic field in the vertical plane of the upper cone 3 and the grounded basal cone 1. The insulator 2, which is interposed between the basal cone 1 and the upper cone 3, allows this electromagnetic field to build between the conical elements in a manner defined by the relative asymmetry of the basal cone 1 and the upper cone 3.

The insulator 2, alternatively described as the bicone insulator, preferably provides the sole mechanical support of the upper cone 3. For an exemplary embodiment, the insulator 2 comprises a shaped non-conductive material having an internal UNF 4-40 thread and an UNC 10-24 external thread. The top portion of the insulator 2 comprises a female contact receptacle that accepts the bottom tip of the upper cone 3 (and the pin receptacle 9). The bottom portion of the insulator 2 comprises a male contact member that can be inserted within the opening within the top flat surface of the basal cone 1. An opening extending along the length of the insulator 2 can accept the center conductor of the coaxial cable 8. This configuration for the insulator 2 controls the dielectric capacitance between the bicone elements 1 and 3 and forms a dielectric loading of a low impedance coaxial transmission line.

Figure 5A:
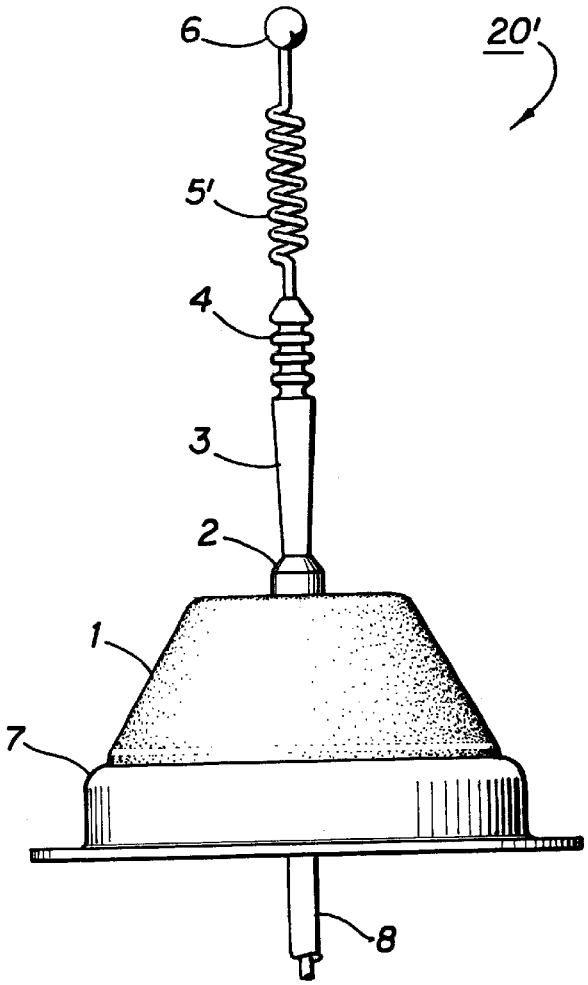
FIG. 5A is an illustration showing an enlarged detail of a cross sectional-view of an antenna constructed in accordance with an alternative embodiment of the present invention.

FIG. 5A shows an alternate embodiment of the antenna assembly for low-profile antenna applications. Referring to FIG. 5A, an antenna assembly 20' comprises a dipole element 5' having an open coil or spring-type configuration, instead of the linear rod configuration for the dipole element 5 shown in FIGS. 1–4. This open coil design provides more durability for certain exposed antenna applications, while satisfying the requirement for conserving available "real estate" for an antenna in a low-profile operating environment. Similar to the antenna 20, the dipole element 5' is coupled to the upper cone 3 via the insulating adapter 4 and can include the plastic end cap 6 at the opposite end, the terminating point of the coil. The opposite end of the upper cone 3 is indirectly connected to the apex of the base cone 1 via the insulator 2. The insulator 2 electrically isolates the conductive surfaces of the cones while supporting the stacking of these cones within the vertical plane of the antenna assembly 20'. The pair of asymmetrical-shaped cones 1 and 3 can passively couple electromagnetic energy to and from the dipole element 5' in a manner similar to that described above with respect to the antenna 20. In this manner, the dipole element 5' can support both transmission and reception operations for the antenna assembly 20'.

Figure 5B:
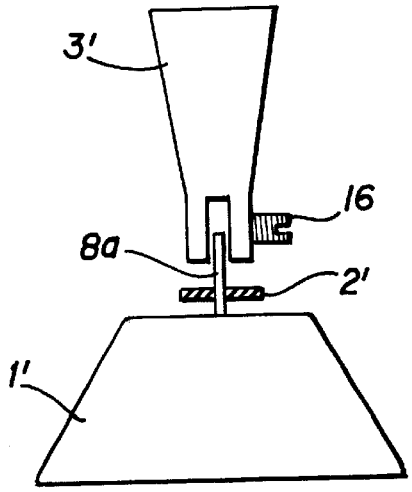
FIG. 5B is an illustration showing an exploded view of an assembly of a pair of cones separated by a bicone insulator in accordance with an alternative embodiment of the present invention.

FIG. 5B provides an illustration of an exploded view of an assembly of bicone elements separated by an insulator in accordance with an alternative exemplary embodiment of the inventive antenna. Focusing upon the junction formed by the insulator 2' placed between the lower and upper cones 1' and 3', the center conductor 8*a* passes through the lower cone 1', the insulator 2', and into a receptacle of the upper cone 3'. The center conductor 8*a* can be connected to the upper cone 3' by adjusting a set screw 16 located along one side of the upper cone 3' and proximate to the cone receptacle that accepts the center conductor. In this manner, the center conductor 8*a* is connected to the upper cone 3' without the use of a solder connection. The set screw is inserted within a threader receptacle along a side of the upper cone 3' and can be adjusted by manually turning the set screw within the threaded receptacle. This solderless section of the center conductor 8*a* to the upper cone 3' supports a low cost assembly of the antenna without a need for tools.

Figure 6A:
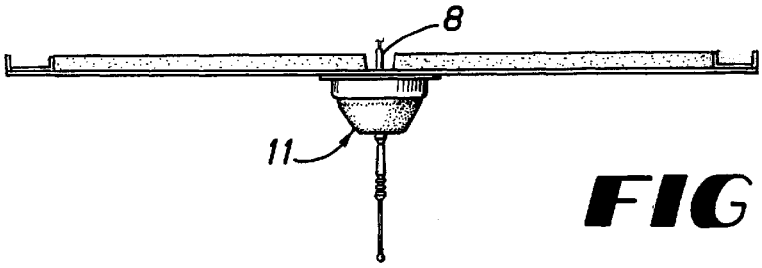
FIG. 6A is an illustration showing a cross sectional-view of a ceiling- or wall-mounted enclosure for a computing device connected to an antenna in accordance with a representative operating environment for an exemplary embodiment of the present invention.
Figure 6B:
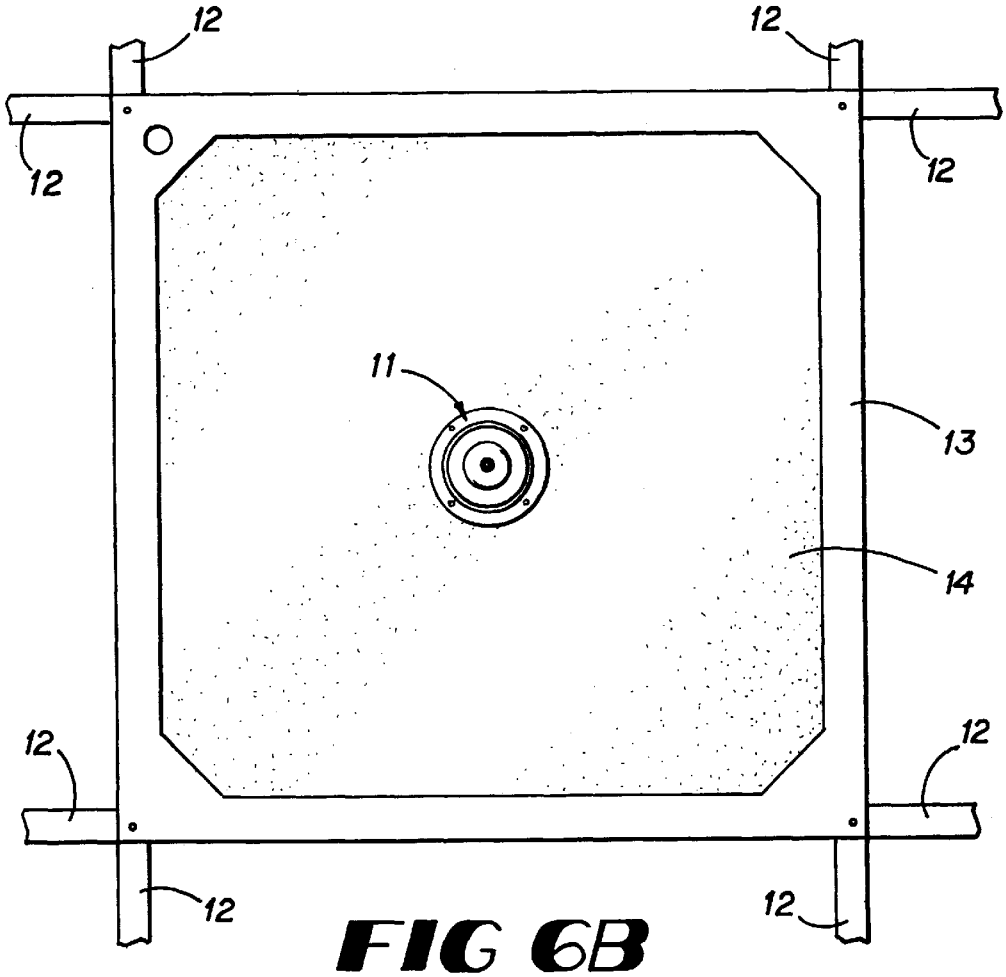
FIG. 6B is an illustration showing a planar view of the representative antenna mounted for use in the operating environment shown in FIG. 6A.

FIGS. 6A and 6B show an antenna assembly mounted for operation in a typical operating environment of a WLAN, i.e., a ceiling tile (or wall) mounting within the interior of a facility having one or more wireless network access points that communicate with a central computer via the wireless communications network. This operating environment and the ceiling/wall tile mounting and associated enclosure for a communication device, such as a wireless network access point, is described in detail in U.S. patent application Ser. No. 09/092,621, filed on Jun. 5, 1998, which is assigned to the assignee of the present application and is fully incorporated herein by reference. For example, a wireless network access point can be enclosed within an ceiling- or wall-mounted enclosure in an interior building structure. The antenna for this wireless network access point can be provided by the antenna assembly 20 shown in FIGS. 1–4 or the antenna assembly 20' of FIG. 5A. This antenna can be mounted to a receptacle, located in either the cover of the enclosure or within the enclosure itself, and typically extends into the room environment. Consequently, the low-profile characteristics of the antenna assemblies 20 and 20' are particularly well suited for this wireless communication application.

Referring to FIGS. 6A and 6B, for a representative ceiling-mount configuration, the stacked antenna assembly is centrally mounted over the conductive surface of a ceiling tile 14, which is welded to a mounting frame 13 of an enclosure that fits within a conventional ceiling tile grid 12. This enclosure typically houses a computing device, such as a wireless network access point, connected to an antenna to support wireless communications, such as WLAN applications. An antenna assembly 11, which can be implemented by either the antenna assembly 20 shown in FIGS. 1–4 or the antenna assembly 20' in FIG. 5, is mounted vertically, pointing down from its ceiling location along the ceiling tile 14. The antenna assembly 20 can be mounted directly to the exterior portion of the ceiling tile 14 or, in the alternative, this antenna can be mounted within the enclosure and extend through an aperture within the ceiling tile 14. For example, a coaxial cable, connected to the computing device mounted within the enclosure, can enter through an aperture in the ceiling tile 14 to centrally feed the antenna assembly 11.

When the antenna assembly 11 is mounted over the conductive surface of the ceiling tile 14, the larger ground plane afforded by the metal tile surface produces a stronger electromagnetic field. This results in a stronger passive coupling of electromagnetic energy within the vertical plane to the dipole element 5 (or the dipole element 5'). The enhanced signal quality which ultimately results, along with the unobtrusive nature of the ceiling mounting in an indoor workplace setting, provide significant advantages for exemplary embodiments of the present invention over existing antenna alternatives in WLAN applications.

Figure 7:
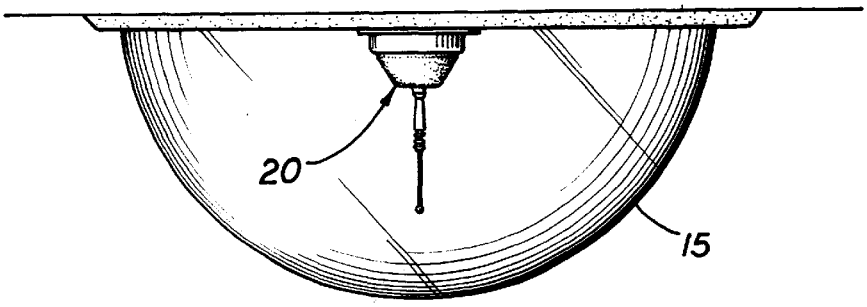
FIG. 7 is an illustration showing a cross sectional-view of an antenna covered by a radome in accordance with an alternative operating environment of an exemplary embodiment of the present invention.

FIG. 7 shows an alternative embodiment of a ceiling-mounted antenna installed within a protective radome. As shown in FIG. 7, the antenna assembly 20 (or the antenna assembly 20') can be housed within a radome 15 to protect the antenna components from exposure to the operating environment. The shape of the non-conductive surface of the radome 15 may be varied to best fit the shape of the antenna 20 and the aesthetic considerations of the particular application. The radome 15 preferably comprises a material that is substantially transparent to radio frequency signals that are transmitted and received by the antenna assembly housed within the radome.

In view of the foregoing, it will be appreciated that the invention provides an antenna assembly including a cone assembly for passively coupling electromagnetic signals to and from an antenna element. It should be understood that the foregoing relates only to the exemplary embodiments of the present invention, and that numerous changes may be made therein without departing from the spirit and scope of the invention as defined by the following claims.

The invention claimed is:

1. An antenna assembly, comprising:

a cone assembly comprising at least two structures of conductive material for generating electromagnetic signals, a dielectric substance separating the at least two structures of conductive material, the cone assembly operative to passively feed the electromagnetic signals within the vertical plane of the antenna assembly to an antenna element; and the antenna element, mounted to the cone assembly within the vertical plane of the antenna assembly, operative to radiate the electromagnetic signals in response to passive feeding of the electromagnetic signals by the cone assembly.

2. The antenna assembly recited in claim 1, wherein the two structures form a bicone having a basal cone of conductive material and an upper cone of conductive material, the upper cone mounted above the basal cone within the vertical plane of the antenna assembly.

3. The antenna assembly recited in claim 2, wherein each structure of the bicone comprises a truncated cone of conductive material that is asymmetrical relative to an opposing cone.

4. The antenna assembly recited in claim 2 further comprising a coaxial cable for carrying the electromagnetic signals to the cone assembly, the coaxial cable comprising a central coaxial conductor provided to a common junction between the cones, the coaxial lead connected to the upper cone and electrically isolated from the basal cone.

5. The antenna assembly recited in claim 2, wherein the basal cone is hollow and bell-shaped, with a lower surface characterized by a broad base and a narrower, flattened upper surface.

6. The antenna assembly recited in claim 2, wherein the upper cone comprises an inverted, narrow-angled cone of conductive material.

7. The antenna assembly recited in claim 2, wherein an end of the basal cone and an end of the upper cone are connected at a common junction by the dielectric substance, the dielectric substance comprising an insulator having low permittivity, thereby electrically isolating the conductive surfaces of the basal cone from the upper cone.

8. The antenna assembly recited in claim 7, wherein the insulator accepts a receptacle pin of conductive material, the insulator operative to connect to a central aperture of the basal cone and to interface with the upper cone, the receptacle pin connected to the upper cone and operative to accept a conductor of a coaxial cable carrying the electromagnetic signals to the antenna assembly, the coaxial lead extending through the central aperture of the basal cone and into the receptacle pin via the insulator.

9. The antenna assembly recited in claim 8, wherein the coaxial cable passes through the central axis of the basal cone, the coaxial cable comprising an outer conductor that terminates in contact with the basal cone and the central coaxial conductor that terminates at the receptacle pin, the central coaxial conductor passing though the insulator separating the basal cone from the upper cone and contacting the receptacle pin, thereby resulting in an active feed of the electromagnetic signals to the upper cone.

10. The antenna assembly recited in claim 2, wherein the antenna element comprises a cylinder of conductive material, the cylinder attached to the upper cone by an insulating adapter and mounted within the vertical plane of the antenna assembly.

11. The antenna assembly recited in claim 10, wherein a combination of the basal and upper cones, responsive to the delivery of the electromagnetic signals by a coaxial cable to a common junction between the cones, generates an electromagnetic field within the vertical plane of the antenna assembly to passively stimulate the antenna element, thereby resulting in radiation of the electromagnetic signals by the antenna element.

12. The antenna assembly recited in claim 2, further comprising an insulator for attachment to the basal cone, the insulator operative to mount the antenna assembly to a mounting surface.

13. The antenna assembly recited in claim 2, wherein the antenna element comprises a coil of conductive material.

14. The antenna assembly recited in claim 2, further comprising a radome covering the combination of the antenna element and the cone assembly, thereby protecting the antenna assembly from enviromnental effects.

15. The antenna assembly recited in claim 1, wherein the cone assembly is mounted proximate to a conductive ceiling tile for a ceiling-mounted enclosure housing a communications device connected to the cone assembly via a coaxial cable carrying the electromagnetic signals for radiation by the antenna element.

16. The antenna assembly of claim 1, wherein the cone assembly comprises a basal cone of conductive material and an upper cone of conductive material, the upper cone mounted above the basal cone within the vertical plane of the antenna assembly, the upper cone electrically insulated from the basal cone by the dielectric substance, the dielectric substance comprising a threaded insulator having low permittivity and positioned between the upper cone and the basal cone, the threaded insulator having a threaded, female contact receptacle for receiving a bottom portion of the upper cone and a threaded, male contact member for insertion into an opening within a top portion of the basal cone, wherein the threaded insulator supports an efficient assembly of a common junction formed by the combination of the basal cone and the upper cone.

17. The antenna assembly of claim 16, wherein the bicone insulator controls the dielectric capacitance between the upper cone and the basal cone.

18. The antenna assembly of claim 16 further comprising a coaxial cable for carrying electromagnetic energy to and from the antenna assembly, the coaxial cable having a center conductor and an outer conductor, the center conductor passing through the opening of the basal cone and into an opening extending along the length of the threaded insulator for connection to the upper cone, thereby providing a dielectric loading of a low impedance coaxial transmission line.

19. The antenna assembly of claim 18, wherein the center conductor of the coaxial cable is connected to the upper cone via a receptacle pin positioned at a tip of the center conductor, the receptacle pin extending into an opening of the upper cone when the upper cone is threaded into the female contact receptacle of the threaded insulator.

20. The antenna assembly of claim 18, wherein the center conductor of the coaxial cable is electrically connected to the upper cone by a direct electrical contact formed by the connection of the receptacle pin to the upper cone, thereby avoiding use of a solder joint for the electrical connection of the coaxial cable to the antenna assembly.

21. An antenna assembly, characterized by a low-profile configuration, for communicating electromagnetic signals, comprising:

an asymmetrically-shaped bicone assembly operative to passively feed electromagnetic signals within the vertical plane of the antenna assembly to an antenna element, the bicone assembly comprising a conductive basal cone and a conductive upper cone mounted above the basal cone within the vertical plane of the antenna assembly;

the antenna element, mounted to the upper cone within the vertical plane of the antenna assembly, operative to radiate the electromagnetic signals in response to passive coupling of the electromagnetic signals by the bicone assembly; and a coaxial cable for carrying electromagnetic signals between a communications device and a common junction between the basal and upper cones, the coaxial cable comprising a central lead connected to the upper cone and electrically isolated from the basal cone and an outer conductor connected to the basal cone.

22. The antenna assembly recited in claim 21, wherein the basal cone and the upper cone comprise asymmetric, truncated cones of conductive material, the basal cone having a hollow and bell-shaped configuration, with a lower surface characterized by a broad base and a narrower, flattened upper surface and the upper cone comprising an inverted, narrow-angled, solid cone of conductive material.

23. The antenna assembly recited in claim 22, further comprising a mounting element comprising a non-conductive material for mounting the upper cone to the basal cone, thereby electrically isolating the conductive surfaces of the basal cone and the upper cone.

24. The antenna assembly recited in claim 23, wherein the mounting element is operative to accept the lead of the coaxial cable, mounting element shielding the lead from the conductive surface of the basal cone and directing the lead in contact with the conductive surface of the upper cone, thereby resulting in an active feed of the electromagnetic signals to the upper cone.

25. The antenna assembly recited in claim 21, wherein the antenna element comprises a cylindrical pin of conductive material, the pin attached to the upper cone by an insulating adapter mounted within the vertical plane of the antenna assembly.

26. The antenna assembly recited in claim 21, wherein the antenna element comprises a coil of conductive material.

27. The antenna assembly recited in claim 21, wherein the basal cone is mounted proximate to a ground plane comprising a cover plate of conductive material for a ceiling or wall-mounted.

* * * * *